US006148813A

United States Patent [19]

Barnes et al.

[11] Patent Number: 6,148,813

[45] Date of Patent: Nov. 21, 2000

[54] TELESCOPING OVEN RACK ASSEMBLY

[75] Inventors: Shelton T. Barnes, Chattanooga; Perry A. Bennett, Cleveland; Earl T. Rhinehart, Apison, all of Tenn.

[73] Assignee: Maytag Corporation, Newton, Iowa

[21] Appl. No.: 09/375,562

[22] Filed: Aug. 17, 1999

[51] Int. Cl.[7] ..... F24C 15/16; A47B 11/00

[52] U.S. Cl. ..... 126/339; 126/337; 126/340; 126/332 R; 126/41 D; 108/143; 312/408; 384/19

[58] Field of Search ..... 126/339, 337, 126/332 R, 340, 41 D; 312/408; 108/143; 384/19

[56] References Cited

U.S. PATENT DOCUMENTS

| | | | |
|---|---|---|---|
| 878,434 | 2/1908 | Houten | 126/339 |
| 1,206,730 | 11/1916 | Rideout . | |
| 1,772,534 | 8/1930 | Breitwieser | 126/339 |
| 1,896,307 | 2/1933 | Hatch . | |
| 1,946,532 | 2/1934 | Hatch . | |
| 1,960,365 | 5/1934 | Barker | 126/339 |
| 1,961,391 | 6/1934 | Reedy et al. | 126/339 |
| 1,974,830 | 9/1934 | Moecker . | |
| 1,997,432 | 4/1935 | Replogle | 126/339 |
| 1,998,343 | 4/1935 | Teller et al. | 126/339 |
| 2,011,189 | 8/1935 | Anderson . | |
| 2,033,792 | 3/1936 | Sywert et al. | 126/339 |
| 2,033,859 | 3/1936 | Otte | 126/339 |
| 2,088,957 | 8/1937 | Hoffstetter et al. | 126/339 |
| 2,095,811 | 10/1937 | Goulooze | 126/339 |
| 2,157,608 | 5/1939 | Hoffstetter et al. | 126/339 |
| 2,168,172 | 8/1939 | Rees . | |
| 2,207,115 | 7/1940 | Carr | 126/339 |
| 2,225,991 | 12/1940 | Hobson . | |
| 2,265,421 | 12/1941 | Donnelly | 126/339 |
| 2,299,885 | 10/1942 | Ellsworth et al. | 126/339 |
| 2,307,233 | 1/1943 | Opgenorth | 126/339 |
| 2,420,173 | 5/1947 | Hall . | |
| 2,466,360 | 4/1949 | Bitney . | |
| 2,486,564 | 11/1949 | Kamin | 126/339 |
| 2,724,630 | 11/1955 | Saunders | 312/408 |
| 2,804,068 | 8/1957 | Miller et al. | 126/339 |
| 2,806,467 | 9/1957 | Slaughter . | |
| 2,873,150 | 2/1959 | Hutzelman | 126/340 |
| 2,899,255 | 8/1959 | Evans . | |
| 3,106,202 | 10/1963 | Arduna . | |
| 3,195,970 | 7/1965 | Chuboff . | |
| 3,288,302 | 11/1966 | Fitzpatrick et al. | 108/143 |
| 3,550,580 | 12/1970 | Wong . | |
| 3,664,716 | 5/1972 | Johnson | 384/19 |
| 3,877,767 | 4/1975 | Bright | 312/408 |
| 3,976,000 | 8/1976 | Oxel . | |
| 4,194,495 | 3/1980 | Scherer . | |
| 4,447,095 | 5/1984 | Fielding | 384/19 |
| 4,651,713 | 3/1987 | Ondrasik, II . | |

FOREIGN PATENT DOCUMENTS

| | | | |
|---|---|---|---|
| 2266110 | 10/1975 | France | 126/339 |

*Primary Examiner*—Ira S. Lazarus
*Assistant Examiner*—David Lee
*Attorney, Agent, or Firm*—Everett G. Diederiks, Jr.

[57] ABSTRACT

A telescoping rack assembly for an oven cavity includes a rack extendable upon a primary rack frame which, in turn, is mounted for sliding movement relative to the oven cavity. Therefore, with this arrangement, multiple extensions for the rack is available. The rack is preferably supported upon guides carried by the rack frame, along with multiple sets of rollers. A secondary rack frame can be provided to slidably support the primary rack frame such that a further extension is available.

20 Claims, 7 Drawing Sheets

32
109
102
119
111
114
129
112
117
107
104
124
130
122
123
121
127
118
126
82
74
71
44
60
47
85
78
63
83
77
86
67
79
99
88
91
59
94
49

TELESCOPING OVEN RACK ASSEMBLY

BACKGROUND OF THE INVENTION

1. Field of the Invention

The present invention pertains to the art of cooking appliances and, more particularly, to a telescoping rack assembly provided in an oven cavity.

2. Discussion of the Prior Art

In a cooking appliance including an oven cavity, such as an electric or gas range, wall oven or the like, it is known to provide one or more racks within the oven cavity to support food items to be cooked. To aid in accessing the food items placed within an oven cavity, particularly when the food is to be removed from the oven cavity, it is known to mount a typical oven rack for sliding movement into and out of the oven cavity.

In one common arrangement, side walls of an oven cavity are integrally formed with elongated rails upon which a rack is slidably positioned. Such a rack system typically enables the rack to slide out of the oven cavity a predetermined distance due to the inclusion of a stop arrangement between the rack and the rails. In another known configuration, a frame which carries an extendable rack is mounted within an oven cavity.

Regardless of the particular type of extensible rack arrangement provided in accordance with the prior art, the degree to which the rack can extend out of the oven cavity is limited. That is, the prior art generally provides for only a single rack extension regardless of the particular rack mounting arrangement utilized. Given that a substantially percentage of the rack must be maintained in a directly supported position upon the rails or frame in the extended position, the actual extent to which the rack can be extended out of the oven cavity is limited. Of course, the farther the rack can be drawn from the oven cavity, the more convenient it is to position food items upon or remove food items from the rack.

Based on the above, there exists a need in the art for an improved extensible or telescoping rack arrangement for use in an oven cavity. More particularly, there exists a need for an oven rack assembly which enables multiple extensions of the rack out of the oven cavity, yet wherein the rack assembly is designed and mounted in a manner which assures a reliable and structurally sound configuration

SUMMARY OF THE INVENTION

The invention is concerned with providing a telescoping oven rack assembly which allows multiple extensions of the rack out of an oven cavity. In accordance with a first embodiment of the invention, a rack frame is provided which is adapted to be extensibly mounted within an oven cavity in a manner similar to a conventional oven rack. However, the rack frame incorporates rail structure for slidably supporting a rack. With this arrangement, the rack can telescope relative to the oven cavity for multiple extensions, with one extension being provided by the relative sliding movement of the rack relative to the rack frame and a second extension being provided by the movement of both the rack and rack frame relative to the oven cavity.

In the most preferred form of the invention, the rail structure carried by the rack frame is defined by rollers and roller guides. More specifically, a pair of laterally spaced, first and second guides are secured to or formed integral with the rack frame, with the guides opening laterally inwardly. A rear portion of the rack carry a pair of laterally spaced rollers which are received within the first and second guides respectively. In addition, frontal portions of the rack frame carry a pair of rollers which also support the rack for easy and smooth sliding movement relative to the rack frame. Engagement structure acting between the rack and rack frame define stops which establish fully extended and retracted positions for the rack.

In accordance with another embodiment of the invention, a dual rack frame arrangement is utilized to telescopingly support a rack for multiple extensions relative to an oven cavity. More specifically, a first rack frame, which is slidably mounted for movement into and out of the oven cavity, extensibly supports a second rack frame, preferably through the use of a combination of guide rails and rollers. The second rack frame further slidably supports a rack. The invention further contemplates forming the second rack frame with upstanding side wall defining support structure for the rack wherein the rack is also selectively, vertically adjustable relative to the second rack frame within the oven cavity. In any event, in accordance with this arrangement, the rack has essentially three extension stages relative to the oven cavity.

Given the high temperatures developed in a conventional oven, the incorporation of a telescoping rack assembly in an oven cavity according to the present invention has particular advantages which have not heretofore been recognized. Additional objects, features and advantages of the invention will become more readily apparent from the following detailed description of preferred embodiments thereof, when taken in conjunction with the drawings wherein like reference numerals refer to corresponding parts in the several views.

DETAILED DESCRIPTION OF THE PREFERRED EMBODIMENTS

Figure 1:
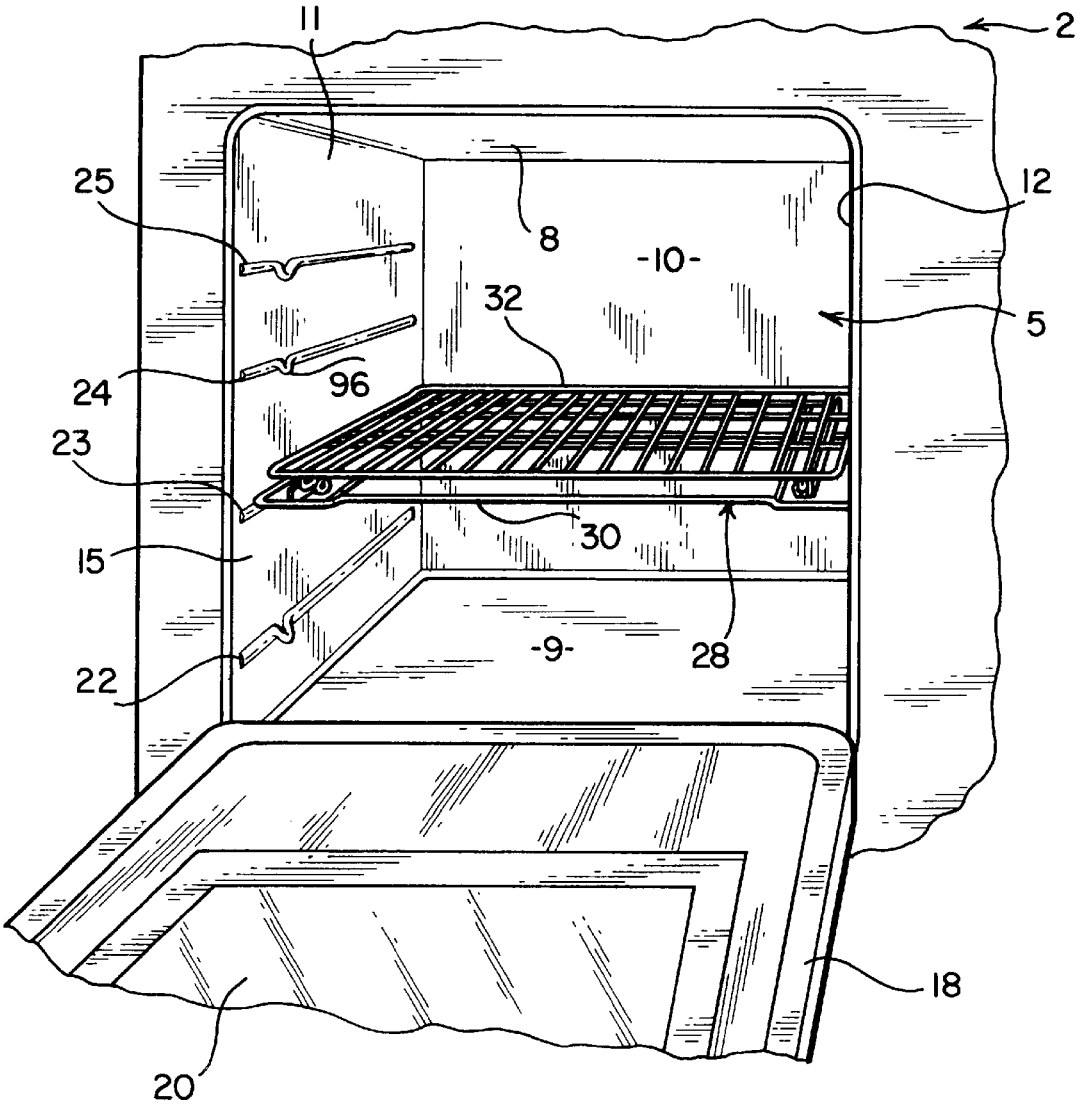
FIG. 1 is a perspective view of an oven cavity incorporating a telescoping rack assembly constructed in accordance with a first embodiment of the invention.

With initial reference to FIG. 1, a portion of a cooking appliance 2 is generally indicated to include an oven cavity 5 formed from top, bottom, rear and side walls 8–12 respectively. Oven cavity 5 includes an open frontal portion 15 which can be selectively closed by means of a pivotally mounting door 18 that is provided with a viewing window 20. Opposing sidewalls 11 and 12 of oven cavity 5 are preferably formed integrally with or have attached thereto various vertically spaced rails, four of which are indicated at 22–25 for sidewall 11.

FIG. 1 also illustrates the inclusion of a telescoping oven rack assembly 28, which is constructed in accordance with a first preferred embodiment, arranged within oven cavity 5. Telescoping oven rack assembly 28 assembly is supported for movement relative to the oven cavity 5 upon a respective set of the rails 22–25. More specifically, the telescoping oven rack assembly 28 includes a lower rack frame 30 and an upper rack 32 as will be detailed more fully below. Oven rack frame 30 can be selectively positioned upon a respective set of rails 22–25 such that telescoping oven rack assembly 28 is vertically adjustable within oven cavity 5. Telescoping oven rack assembly 28 is also adapted for movement relative to oven cavity 5 to extended and retracted positions as will become more fully evident below.

Prior to detailing the preferred construction of oven rack assembly 28, at this point it should be noted that rails 22–25 are shown spaced vertically on sidewall 11 a considerable distance. This distance was selected for the drawing for the sake of clarity. However, in the most preferred form of the invention, additional rails are provided such that if oven rack assembly 28 is supported upon the set of rails 23 as shown in this figure, the top of oven rack assembly 28 is directly juxtaposed an adjacent rail to limit any vertical deflection or rotation of oven rack assembly 28 within oven cavity 5. This aspect of the invention will also become more fully apparent below when considering the structure of the telescoping oven rack assembly 28.

Figure 2:
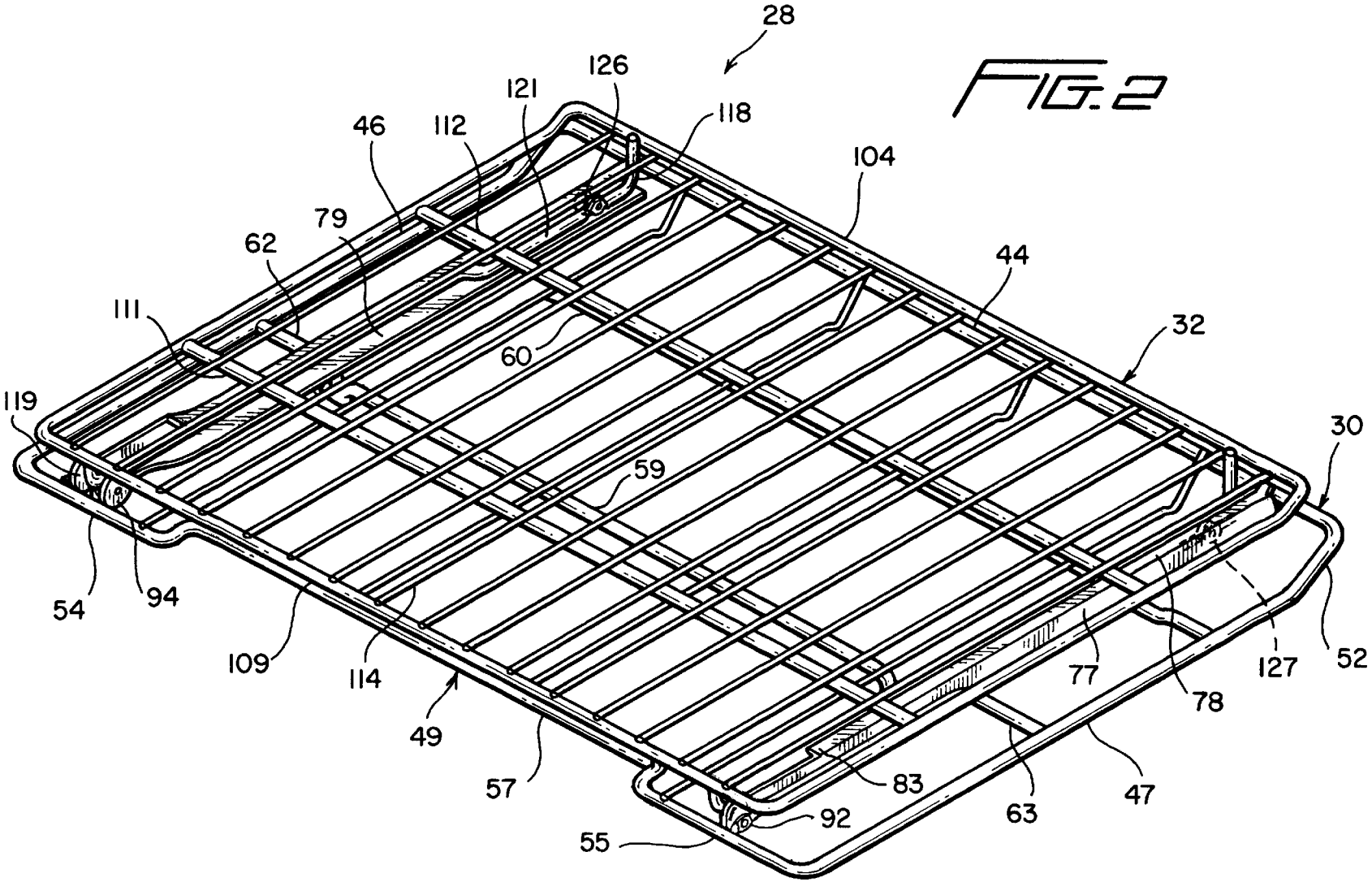
FIG. 2 is a perspective view of the rack assembly of FIG. 1 shown in a fully retracted position.
Figure 3:
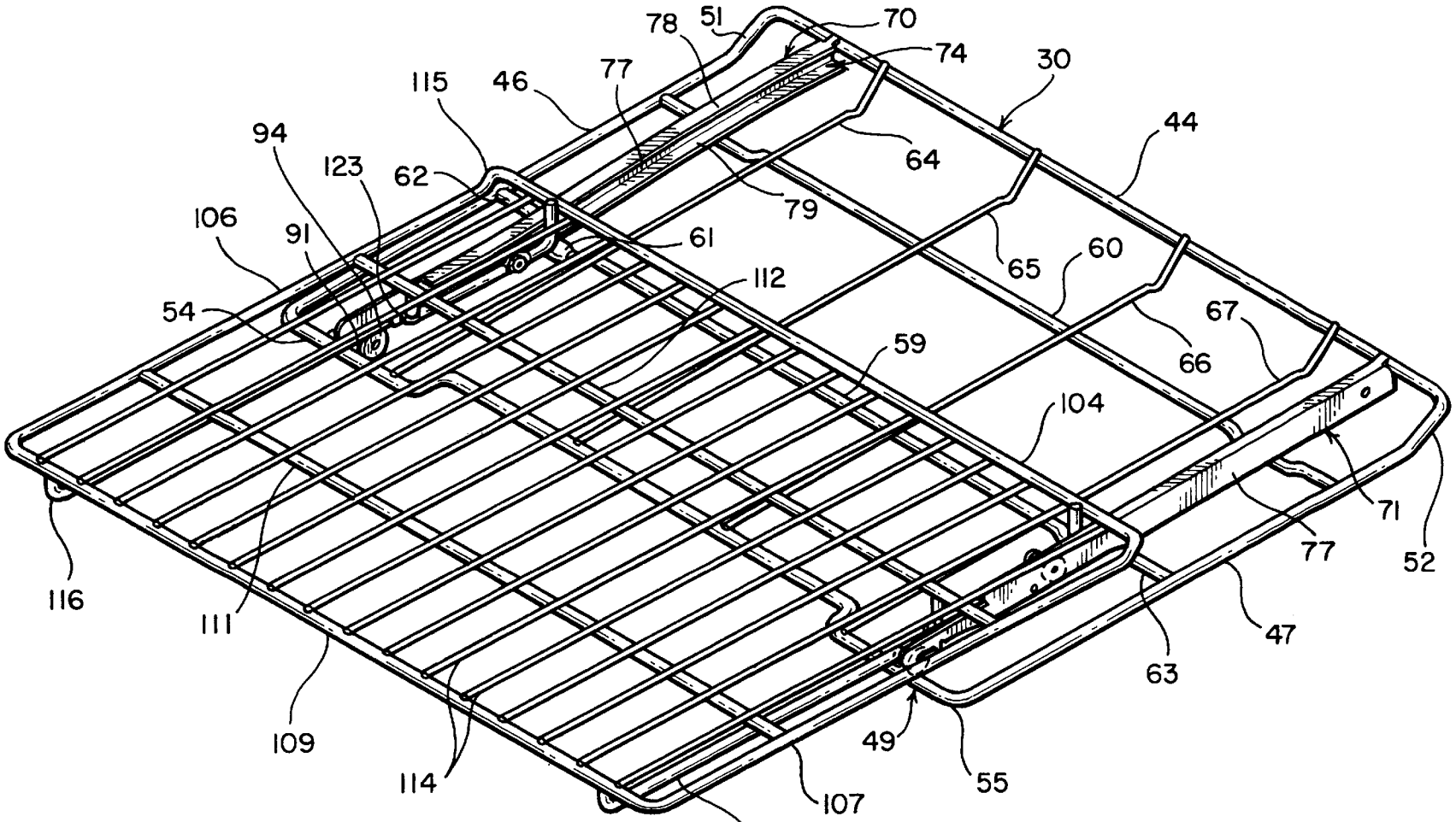
FIG. 3 is a perspective view of the rack of FIG. 2 shown in an extended position.
Figure 4:
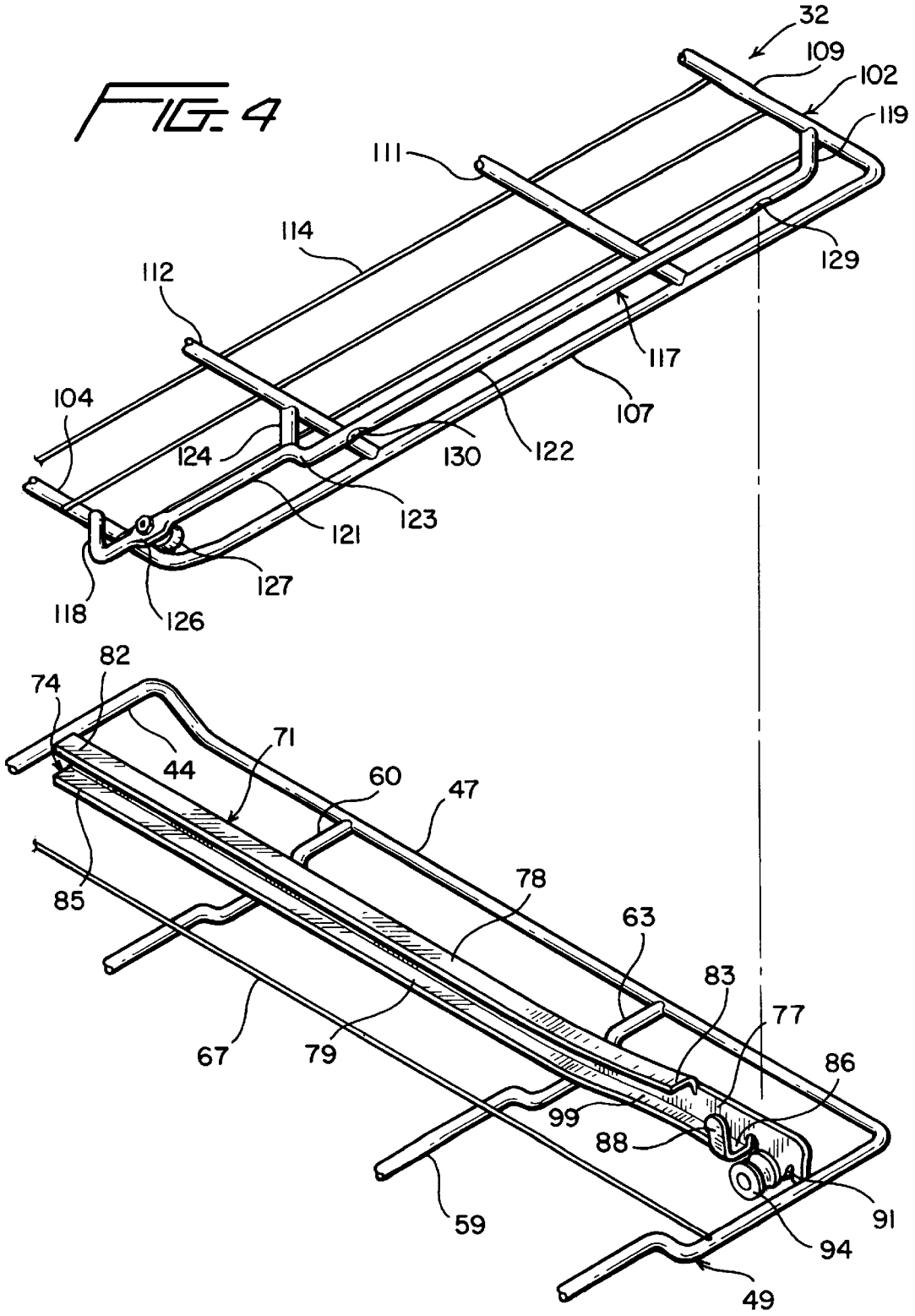
FIG. 4 is an exploded view of a section of the telescoping rack assembly of FIG. 1, with a component of the rack assembly being inverted.

Reference will now be made to FIGS. 2–4 in describing a first preferred embodiment for telescoping oven rack assembly 28. As shown in these figures, rack assembly 28 includes the rack frame 30 which is preferably formed from a chrome metal rod. Frame 30 includes a rear rod portion 44, side rod portions 46 and 47 and a front rod portion 49. Side rod portions 46 and 47 lead into rear rod portion 44 through upwardly sloping sections 51 and 52 respectively. Front rod portion 49 preferably includes axially aligned end sections 54 and 55, as well as a central section 57 which is arranged parallel to, but offset from, end sections 54 and 55. Frame 30 also includes a pair of fore-to-aft spaced and laterally extending cross rods 59 and 60. Actually, cross rod 59 preferably includes flattened ends such as that shown at 61 and is interconnected to side rod portions 46 and 47, as well as end sections 54 and 55 of front rod portion 49, through respective L-shaped rods 62 and 63. That is, the longer leg of each L-shaped rods 62, 63 is welded or otherwise fixedly secured to a respective end section 54 and 55 and the short leg of each L-shaped rod 62, 63 is attached to a respective one of side rod portions 46 and 47. Cross rod 59 is then attached to the L-shaped rod 62 and 63 so as to be indirectly connected to outer frame 30.

Frame 30 also includes a plurality of laterally spaced and fore-to-aft extending cross wires 64–67. Although cross wires 64–67 can be secured to each of rear rod portion 44, front rod portion 49 and cross rods 59 and 60, the most preferred embodiment has wires 64–67 welded onto rear rod portion 44, front rod portion 49 and cross rod 59 only. Therefore, cross wires 64–67 actually extends slightly above cross rod 60. Frame 30 is also provided with a pair of guide rails 70 and 71. Guide rails 70 and 71 are generally identical and represent mirror images of each other. Each guide rail 70, 71 includes a channel 74 that is defined by an upstanding wall 77 and upper and lower inwardly, generally horizontal walls 78 and 79. With this construction, each channel 74 defines a track. Upper horizontal wall 78 has a rear terminal end 82 that is attached to rear rod portion 44 such as by welding. Wall 78 has a front end 83 which terminates short of front rod portion 49 as clearly shown in these figures. Wall 79 of channel 74 has a rear terminal end 85 which projects below rear rod portion 44, and a front terminal end 86 which is arranged closer to front rod portion 49 then front terminal end 83 of wall 78. However, front terminal end 86 also terminates short of front rod portion 49. At front terminal end 86 of wall 79 is provided an upstanding catch member 88 that is arranged generally parallel to, but inwardly spaced from, upstanding wall 77. As will become more fully evident below, catch member 88 constitutes a stop abutment for limiting the travel of rack 32 relative to frame 30.

The forwardmost portion of upstanding wall 77 is fixed to front rod portion 49. Between front rod portion 49 and front terminal end 86 of wall 78, upstanding wall 77 is also provided with a downwardly extending tab 91. At tab 91 for each of the guide rails 70 and 71, the respective L-shaped rod 62, 63 is preferably formed with a flattened portion 92 (see FIG. 2). Tab 91 and flattened portion 92 are provided with aligned apertures for use in securing roller guide wheels 94. In the most preferred embodiment, roller guide wheels 94 are mounted upon a rivet shaft (not labeled) through the use of ball bearings.

At this point, it should be recognized that side rod portions 46 and 47 are used to support rack frame 30 for sliding movement upon a selective set of rails 22–25 within oven cavity 5. The support of a rack frame 30 within an oven cavity in this fashion is generally conventional. As previously indicated, rails 22–25 would actually be arranged vertically closer together or additional rails would be provided within oven cavity 5. In a manner also known in the art, the rails would also be provided with dependent catch portions, such as that indicated at 96 in FIG. 1, which abut with upwardly sloping sections 51 and 52 of frame 30 to limit the degree of travel of frame 30 out of oven cavity 5. The travel of frame 30 into oven cavity 5 is limited by the abutment of rear rod portion 44 with rear wall 10. As also known in the art in connection with a conventional rack, rack frame 30 can also be removed from oven cavity 5 by lifting of the frontal portion thereof such that upwardly sloping sections 51 and 52 can slide beneath the depending catch portions 96.

In any event, with this support arrangement, side rod portions 46 and 47 generally extend horizontally. Even though rear rod portion 44 is arranged at a higher elevation than front rod portion 49, due to the mounting of guide rails 70 and 71 to rear rod portion 44 at wall 78 of channels 74 and to front rod portion 49 essentially at the height of horizontal wall 79 of channel 74, the track defined by each of guide rails 70 and 71 has a slight slope from front to back. In addition, at a point generally intermediate cross rod 59 and front rod portion 49, the horizontal wall 79 of each channel 74 includes an upwardly sloping zone 99 that leads to catch member 88. This configuration cooperates with the structure of upper rack 32, as will be detailed below, to assure that upper rack 32 will not slide or unintentionally roll out of oven cavity 5, but instead will have a tendency to assume a retracted position.

With further reference to FIGS. 2–4, the preferred construction of upper rack 32 will now be described in detail. Upper rack 32 includes an outer frame 102 preferably defined by a single bent rod that is plated with chrome. More specifically, outer frame 102 includes a rear rod portion 104, side rod portions 106 and 107 and a front rod portion 109. In addition, outer frame 102 is provided with a pair of fore-to-aft spaced and laterally extending cross rods 111 and 112, as well as a plurality of laterally spaced and fore-to-aft extending cross wires 114. In the most preferred form of the invention, each cross wire 114 is secured atop front portion 109, as well as cross rods 111 and 112, and beneath rear rod portion 104 which projects slightly above front rod portion 109 due to the presence of rear, upwardly sloping sections 115 of side rod portions 106 and 107.

In accordance with the invention, upper rack 32 is also provided with a pair of laterally spaced support rods 116 and 117. In essence, the construction and arrangement of support rods 116 and 177 are identical such that the following description of one support rod 116, 117 reflects the structure of each of the support rods 116 and 117. As shown, the support rod 116, 117 includes downwardly extending end portions 118 and 119. Downwardly extending end portion 118 leads to a first forwardly extending section 121 and then to a second forwardly extending section 122. The second forwardly extending section 122 is laterally offset from first forwardly extending section 121 by connecting portion 123. Also, second forwardly extending section 122 merges with downwardly extending end portion 119. Adjacent connecting portion 123 is preferably provided a post 124 which interconnects support rod 116 with cross rod 112.

Forwardly extending end section 121 is provided with a flattened portion 126 at a position slightly forward of downwardly extending end portion 118. At flattened portion 126 is mounted a roller wheel 127. In the most preferred embodiment, each roller wheel 127 projects laterally outwardly from first forwardly extending section 121 and can be secured to flattened portion 126 in any manner known in the art, such as the use of a nut and bolt arrangement. Also, in accordance with the most preferred embodiment, roller wheel 127 is mounted through ball bearings to provide a smooth and enhanced operation.

When mounting rack 32 upon rack frame 30, rack 32 is initially angled downwardly and rearwardly to permit roller wheels 127 to be received within channels 74 of guide rails 70 and 71 between front terminal end 83 of wall 78 and upstanding catch member 88. Rack 32 can then shift backwards relative to rack frame 30 in this angled fashion until each first forwardly extending section 121 and connecting portion 123 clears a respective one of the upstanding catch members 88. Thereafter, rack 32 can be lowered to a generally horizontal position wherein second forwardly extending sections 122 become seated upon roller guide wheels 94. At this point, rack 32 is free to extend and retract relative to rack frame 30.

Rack 32 is limited in shifting rearward by the abutment of downwardly extending end portions 118 with rear rod portion 44. In addition, rack 32 is limited in its forward extended travel, while in the generally horizontal in-use condition, by the engagement of connecting portions 123 with upstanding catch members 88. At least after connecting portions 123 extend below horizontal wall 78 of channel 74, rack 32 is essentially prevented from shifting or pivoting upward relative to rack frame 30. In addition, since support rods 116 and 117 engage roller guide wheels 94 and roller wheels 127 are confined within channels 74, rack 32 cannot pivot downward relative to rack frame 30. With this overall configuration, rack 32 can be slidably shifted relative to rack frame 30 out of oven cavity 5, followed by both rack 32 and rack frame 30 being further shifted relative to oven cavity 5 such that multiple extensions for rack 32 out of oven cavity 5 is provided for. That is, upper rack 32 can slide relative to rack frame 30, either through the use of roller arrangements as in the preferred embodiment described, through direct sliding contact between support rods 116 and 117 and guide rails 70 and 71 or other equivalent arrangements, and rack frame 30 can also slide upon the respective rails 22–25. A user can directly grasp front rod portion 49 of rack frame 30 to simultaneously slide both the rack frame 30 and upper rack 32 relative to oven cavity 5 initially, or upper rack 32 can be extended and further pulled to cause rack frame 32 to shift relative to oven cavity 5. In any event, rack frame 30 is mounted for sliding movement into and at least partially out of oven cavity 5 for a first distance and rack 32 is supported by rack frame 30 for sliding movement relative to rack frame 30 for a second distance, wherein rack 32 is extendable from a retracted position within oven cavity 5 to an extended position by both the first and second distances. With this extension arrangement, upper rack 32 can be entirely positioned outside of oven cavity 5 for easy access to food items placed thereon.

As indicated in FIG. 4, the underside surface of support rods 116 and 117 are preferably notched as shown at 129 and 130. Both of these notches 129 and 130 are arranged along second forwardly extending section 122 of each support rod 116, 117 and are respectively spaced from front rod portion 109 and connecting portion 123. Notches 129 and 130 act as detents in connection with roller guide wheels 94. That is, front notches 129 will tend to seat rack 32 in a rest position relative to rack frame 30 prior to the direct abutment of support rods 116 and 117 with rear rod portion 44. On the other hand, when rack 32 is extended, notches 130 seat upon roller guide wheels 94 prior to direct abutment between connecting portion 123 and upstanding catch members 88. Therefore, as long as rack 32 is extended and retracted in a somewhat slow and smooth fashion, harsh abutments between rack 32 and rack frame 30 can be avoided. In addition, the cooperation between notches 129 and 130 and roller guide wheels 94 generally establishes retracted and extended stop positions for rack 32 relative to rack frame 30.

Figure 5:
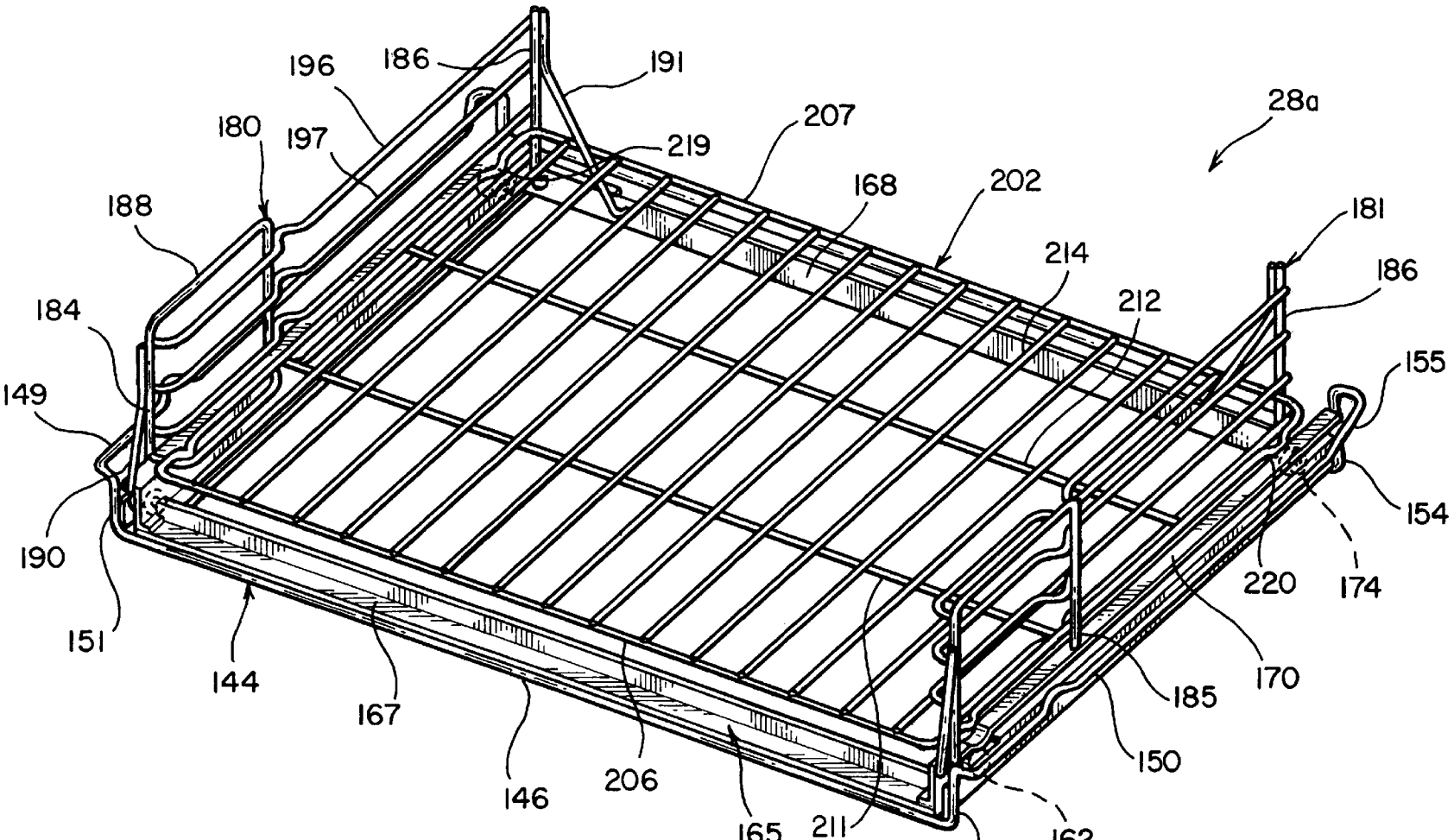
FIG. 5 is a perspective view a telescoping rack assembly, constructed in accordance with a second embodiment of the invention, in a fully retracted position.
Figure 6:
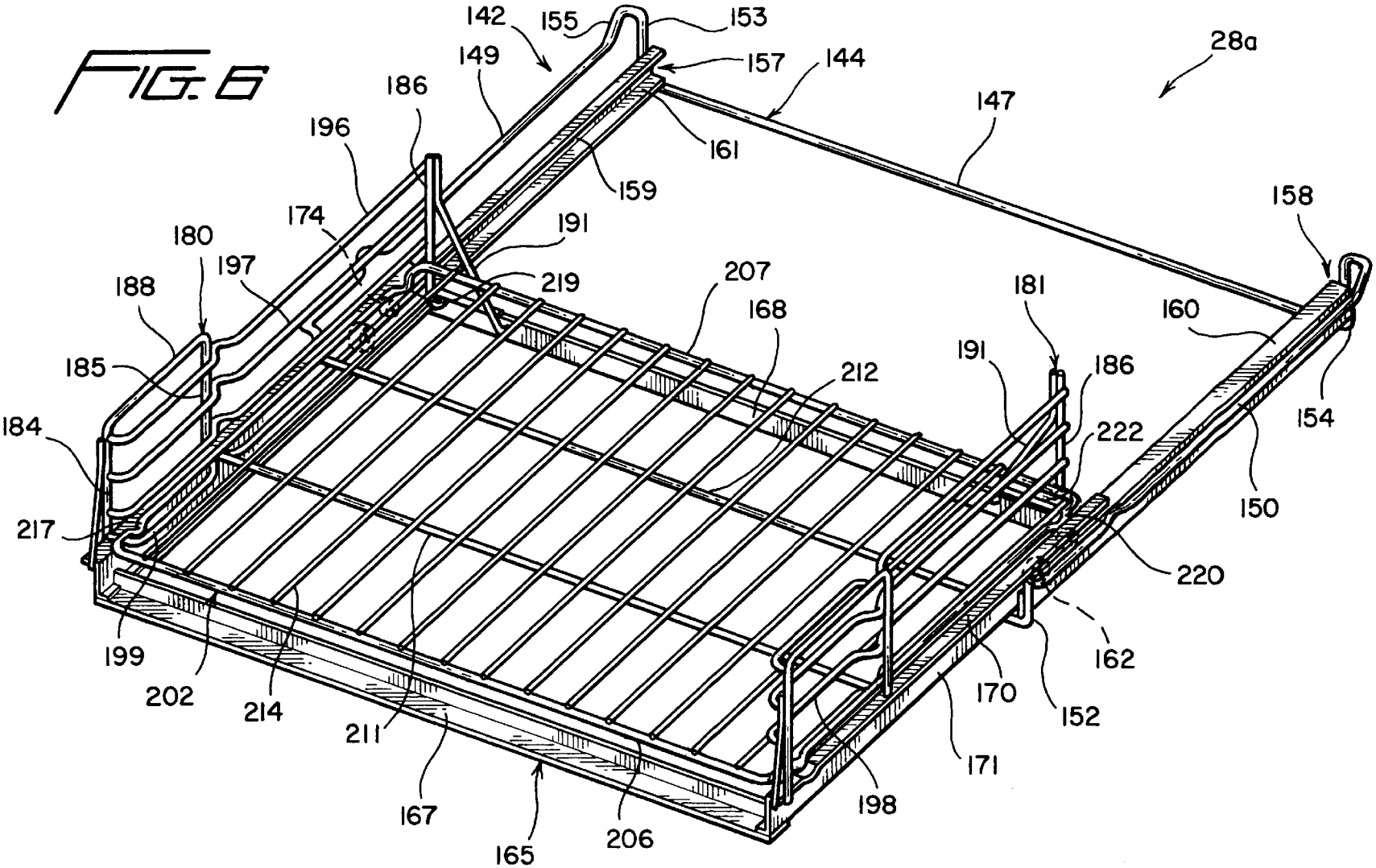
FIG. 6 is a perspective view of the telescoping rack assembly of FIG. 5 shown in a partially extended condition.
Figure 7:
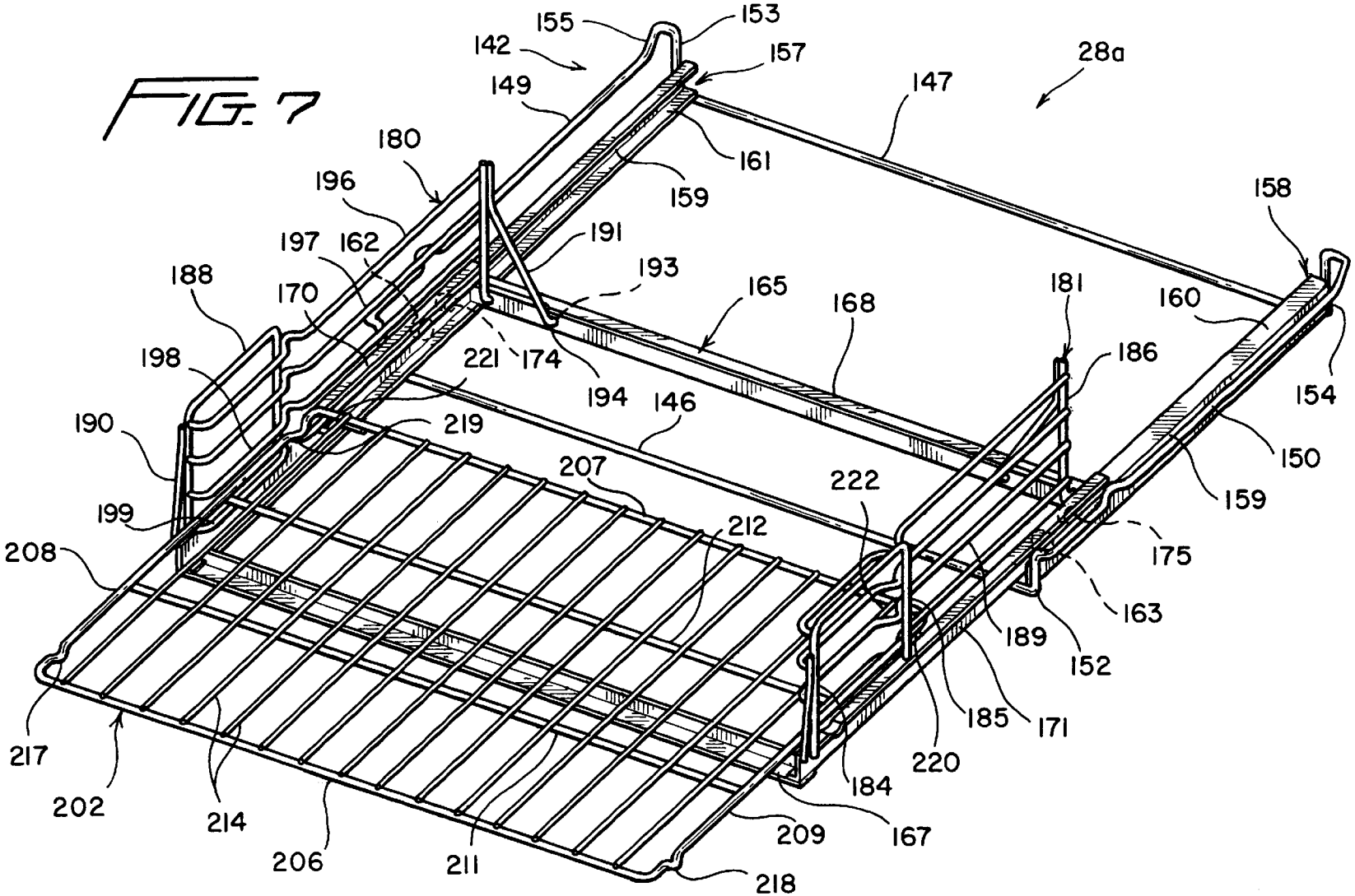
FIG. 7 is a perspective view of the telescoping rack assembly of FIG. 5 shown in a full extended condition.

Reference will now be made to FIGS. 5–7 in describing a telescoping rack assembly **28*a* constructed in accordance with the second embodiment of the invention. The embodiment of FIGS. 1–4 generally provides for a dual extension of rack 32 from oven cavity 5. In accordance with the second embodiment, a further extension is provided for. In this embodiment, there is provided a base rack 142 including a secondary frame 144 defined by a front cross rod 146, a rear cross rod 147 and side rods 149 and 150. As clearly shown in this embodiment, front cross rod 146 is interconnected to side cross rods 149 and 150 through respective upstanding front corner rods 151 and 152. In a similar manner, rear cross rod 147 is interconnected to side rods 149 and 150 through upstanding rear corner rods 153 and 154 respectively. Side rod portions 149 and 150 also preferably include upwardly sloping portions, one of which is indicated at 155, leading to upstanding rear corner rods 153 and 154**.

Frame 144 further includes a pair of channel guides 157 and 158. In general, channel guides 157 and 158 are similarly constructed to channel guide rails 70 and 71 in that channel guides 157 and 158 each includes an upstanding wall 159 and inwardly extending generally horizontal upper and lower walls 160 and 161. Rotatably mounted to the upstanding walls 159 adjacent front cross rod 146 is a pair of roller guide wheels 162 and 163. In a manner similar to the previously described embodiment, it should be understood although perhaps not clearly shown in these figures, that upper horizontal wall 160 of each channel member 157 and 158 extends from rear cross rod 147 a distance short of roller guide wheels 162 and 163.

Telescoping rack assembly **28*a* also includes a secondary rack frame 165 which, in the preferred embodiment shown, includes a front frame member 167, a rear frame member 168 and side frame members 170 and 171. As shown, each of these frame members 167, 168, 170 and 171 is generally constituted by an angled bar, all of which are preferably made from metal and welded together to constitute a generally rectangular frame. More specifically, frame members 167 and 168 are preferably formed with a single 90° bend and frame member 170 and 171** are provided with two 90° bends.

At outer rear portions of side frame members 170 and 171 are rotatably mounted respective rollers 174 and 175. Rollers 174 and 175 are adapted to be positioned within channel guides 157 and 158 in a manner substantially, directly corresponding to that described above with respect to the mounting of roller wheels 127 within channels 74. In addition, the upper, generally horizontally extending portion of each of the side frame members 170 and 171 rests upon roller guide wheels 162 and 163 such that secondary rack frame 165 can be easily slid relative to base rack 142 from the retracted position shown in FIG. 5 to the extended position shown in FIGS. 6 and 7. Due to the presence of roller guide wheels 162 and 163, as well as rollers 174 and 175, secondary rack frame 165 can be smoothly repositioned between its extended and retracted positions. As with the previous embodiment, this sliding movement can be performed without the various rollers, however, the rollers are preferred for ease of operation. Although not shown in the drawings for the sake of clarity, upstanding walls 159 of channel guides 157 and 158 are preferably provided with inward projections adjacent rear corner rods 153 and 154 and slightly rearward of roller guide wheels 162 and 163 for abutment by rear frame member 168 to define the fully extended and retracted positions.

In this embodiment, secondary rack frame 165 also carries a pair of upstanding side rack supports 180 and 181. Each of upstanding side rack supports 180 and 181 includes fore-to-aft spaced upstanding rods 184, 185 and 186, with upstanding rods 184 and 185 preferably being formed from a single rod and including a connecting rod portion 188. Upstanding side rack supports 180 and 181 are preferably reinforced by the inclusion of auxiliary, angled support rods 190 and 191 which are connected to upright rods 184 and 186, as well as side frame member 170 and rear frame member 168 respectively. For ease of assembly, angle support rod 191, for example, can include a bent end 193 which is received within an aperture 194 formed in the upstanding portion of rear frame member 168. A similar support arrangement is also preferably provided for upright rods 186. In addition, side rack supports 180 and 181 also include a plurality of vertically spaced, generally horizontally extending support rods 196–199.

However, the particular manner in which upstanding side rack supports 180 and 181 are constructed and interconnected to frame members 168, 170 and 171 of secondary rack frame 165 can greatly vary in accordance with the present invention without departing from the spirit thereof. Actually, upstanding side rack supports 180 and 181 are provided when it is desired to enable some vertical adjustability of a rack 202 formed as part of the overall telescoping rack assembly 28*a* of the present embodiment. Rack 202 is preferably formed by bending a single metal rod to create a front cross rod 206, a rear cross rod 207 and side rods 208 and 209. Rack 202 also preferably includes a pair of fore-to-aft spaced and laterally extending cross rods 211 and 212, as well as a plurality of laterally spaced and fore-to-aft extending cross wires 214. This general construction of rack 202 is considered fairly conventional and can vary in accordance with the present invention. Preferably side rods 208 and 209 include downwardly bent portions 217 and 218 adjacent front cross rod 206, as well as downwardly bent portions 219 and 220 adjacent rear cross rod 207. Further attached to rear cross rod 207 is a pair of downwardly and laterally, outwardly projecting members 221 and 222 which are adapted to extend below a respective support rod 196–199 upon which rack 202 is slidably supported for movement between a retracted position as shown in FIG. 6 to a fully extended position which is slightly beyond that shown in FIG. 7.

Within this construction, rack 202 can slide relative to secondary rack frame 165, as well as base rack 142. That is, side rods 208 and 209 of rack frame 204 can be selectively supported upon a respective set of horizontal rods 196–199 of upstanding side rack supports 180 and 181 for sliding movement in the fore-to-aft extending direction, with projecting members 221 and 222 functioning to prevent direct lifting of rack 202 relative to secondary rack frame 165 and with the retraction of rack 202 being limited to the direct abutment with upright rods 186 and auxiliary, angled support rods 191. As clearly shown in FIG. 6, when rack 202 is retracted upon secondary rack frame 165, downwardly bent portions 217 and 218 nestle over a laterally outwardly projecting portion (not labeled) of a respective horizontal support rod 196–199. Outward extension of rack 202 is limited by the abutment of bent portions 219 and 220 with a respective horizontal support rod 196–199 as clearly shown in FIG. 7.

Due to the presence of horizontal rods 196–199, rack 202 can be selectively supported in various vertically spaced positions, i.e., rack 202 can be positioned between a selected set of horizontal rods 196–199 for sliding movement between extended and retracted positions, while being prevented from falling downward or undesirably shifting upward. With this construction, it is actually possible to even rest rack 202 atop horizontal rod 199, although this is not a desired operational position as the support rod 196–198 arranged directly above rack 202 functions to prevent the undesired pivoting of the rack 202 relative to secondary rack frame 165. In any event, this embodiment illustrates a manner in which the telescoping rack assembly 28*a* of the present invention can have multiple extensions relative to oven cavity 2 while also accommodating some vertical adjustability of rack 202, in addition to the vertical adjustability provided for in supporting the base rack 142 on a selected set of rails 22–25. In this embodiment, three extensions are available. However, in practical use, base rack 142 will typically remain fixed in oven cavity 5 and the majority of the extensions will take place by sliding secondary rack frame 165 upon base rack 142. Further extension is available by movement of rack 202 relative to secondary rack frame 165. Still further extension can be achieved by the movement of the entire telescoping rack assembly 28*a* relative to oven cavity 5.

Based on the above, it should be readily apparent that each of the embodiments of the present invention accommodates multiple extensions of a rack out of an oven cavity. In each embodiment, the rack is slidably supported, either directly by a rack frame or through the use of rollers or the like. In any event, the rack telescopes relative to the oven cavity for multiple extensions. In the first embodiment, one extension is provided by the sliding movement of the rack 32 relative to the rack frame 30 and the second extension being provided by the movement of both the rack 32 and the rack frame 30 relative to the oven cavity 5. In the second embodiment, the first rack frame 142 is slidably mounted for movement into and out of the oven cavity 5 and extensibly supports a second frame 165, preferably through the use of a combination of guide channels 157 and 158 and rollers 162, 163, 174 and 175. This second rack frame 165 further slidably supports a rack 202, with the second rack frame 165 also accommodating some vertical adjustability of the rack 202 relative thereto. In any event, in accordance with this arrangement, the rack 202 has essentially three potential extension stages relative to the oven cavity 5.

With either of the embodiments, the rack will be capable of projecting from the oven cavity a distance greater than that recognized from conventional rack supporting arrangements. This will enable the user to more easily place food items on the rack, as well as remove food items therefrom. In any event, although described with respect to preferred embodiments of the invention, it should be readily understood that various changes and/or modifications can be made to the invention without departing from the spirit thereof. For instance, although each of the racks and frames described in accordance with the most preferred embodiments of the invention are made from metal rods and wires, other materials such as sheet metal, ceramics or the like could also be used. In fact, the particular construction of the racks and rack frames can greatly vary in accordance with the present invention while still accommodating the multiple extensions for the rack. Therefore, the invention is only intended to be limited by the scope of the following claims.

We claim:

1. A cooking appliance comprising:

an oven cavity having top, bottom, rear and side wall portions and an open frontal portion enabling access to within the oven cavity; and a telescoping rack assembly supported in the oven cavity, said rack assembly including:

a) a rack frame supported by the oven cavity for sliding movement into and at least partially out of the oven cavity;

b) a rack supported by the rack frame for sliding movement relative to both the oven cavity and the rack frame, said rack being extendable from a retracted position wholly within the oven cavity to an extended position outside the oven cavity; and c) a pair of laterally spaced guides on the rack frame, said rack being slidably supported through the guides relative to the rack frame, wherein the guides include lower front end portions which are ramped upwardly to aid in preventing the rack from inadvertently sliding out of the retracted position.

2. The cooking appliance according to claim 1, wherein the rack assembly further comprises a first pair of rollers rotatably mounted on the rack and supported upon the guides.

3. The cooking appliance according to claim 2, wherein the first pair of rollers are mounted adjacent a rear end portion of the rack.

4. The cooking appliance according to claim 2, further comprising: a second pair of rollers supporting the rack for movement relative to the rack frame.

5. The cooking appliance according to claim 4, wherein the second pair of rollers are rotatably connected to a frontal portion of the rack frame, said rack being supported upon the second pair of rollers.

6. The cooking appliance according to claim 1, wherein the side walls of the oven cavity are provided with a plurality of vertically spaced rails, said rack frame being slidably supported upon selected ones of said rails.

7. The cooking appliance according to claim 1, further comprising: at least one stop abutment acting between the rack and the rack frame to limit the extension of the rack relative to the rack frame.

8. A cooking appliance comprising:

an oven cavity having top, bottom, rear and side wall portions and an open frontal portion enabling access to within the oven cavity; and a telescoping rack assembly supported in the oven cavity, said rack assembly including:

a) a rack frame supported by the oven cavity for sliding movement into and at least partially out of the oven cavity;

b) a rack supported by the rack frame for sliding movement relative to both the oven cavity and the rack frame, said rack being extendable from a retracted position wholly within the oven cavity to an extended position outside the oven cavity; and c) at least one stop abstinent acting between the rack and the rack frame to limit the extension of the rack relative to the rack frame, wherein the rack includes a support rod, said support rod including a transversely, substantially horizontally extending portion adapted to engage the at least one stop abutment to limit the extension of the rack.

9. A cooking appliance comprising:

an oven cavity having top, bottom, rear and side wall portions and an open frontal portion enabling access to within the oven cavity; and a telescoping rack assembly supported in the oven cavity, said rack assembly including:

a) a rack frame supported by the oven cavity for sliding movement into and at least partially out of the oven cavity;

b) a rack supported by the rack frame for sliding movement relative to both the oven cavity and the rack frame from a retracted position wholly within the oven cavity to an extended position outside the oven cavity, even with the rack frame being entirely within the oven cavity; and c) a secondary rack frame interposed between the rack frame and the oven cavity such that the rack frame is indirectly supported by the oven cavity and the secondary rack frame is directly, slidably supported by the oven cavity thereby enabling even further extension of the rack outside the oven cavity.

10. The cooking appliance according to claim 9, wherein the rack frame includes a plurality of vertically spaced supports, said rack being slidably supported upon a selective set of the supports.

11. In a cooking appliance including an oven cavity having top, bottom, rear and side wall portions and an open frontal portion enabling access to within the oven cavity, a telescoping rack assembly supported in the oven cavity comprising:

a rack frame supported by the oven cavity for sliding movement into and at least partially out of the oven cavity for a first distance;

a rack supported by the rack frame for sliding movement relative to the rack frame for a second distance, wherein the rack is extendable from a retracted position within the oven cavity to an extended position which is spaced from the retracted position by the first and second distances; and detent means for seating the rack relative to the rack frame in the retracted position.

12. The telescoping rack assembly according to claim 11, wherein the rack assembly further includes a first pair of rollers supporting the rack for movement between the extended and retracted positions.

13. The telescoping rack assembly according to claim 12, wherein the first pair of rollers is provided adjacent a rear end portion of the rack.

14. The telescoping rack assembly according to claim 12, further comprising: a second pair of rollers supporting the rack for movement relative to the rack frame.

15. The telescoping rack assembly according to claim 14, wherein the second pair of rollers is rotatably connected to a frontal portion of the rack frame, said rack being supported upon the second pair of rollers, said detent means including at least one notch provided on the rack, with the notch being adapted to be seated upon a respective one of said second pair of rollers.

16. The telescoping rack assembly according to claim 11, further comprising: a secondary rack frame interposed between the rack frame and the oven cavity such that the rack frame is indirectly supported by the oven cavity and the secondary rack frame is directly, slidably supported by the oven cavity.

17. The telescoping rack assembly according to claim 16, wherein the rack frame includes a plurality of vertically spaced supports, said rack being slidably supported upon a selective set of the supports.

18. The telescoping rack assembly according to claim 16, further comprising:

a first stop abutment acting between the rack and the rack frame to limit the extension of the rack relative to the rack frame; and a second stop abutment acting between the rack frame and the secondary rack frame to limit the extension of the rack frame relative to the secondary rack frame.

19. The cooking appliance according to claim 1, further comprising detent means for seating the rack relative to the rack frame in the retracted position.

20. The telescoping rack assembly according to claim 11, wherein the rack frame further includes a pair of laterally spaced guides, said rack being slidably supported through the guides relative to the rack frame, wherein the guides include lower front end portions which are ramped upwardly to aid in preventing the rack from inadvertently sliding out of the retracted position.

* * * * *